US008727496B2

(12) United States Patent
Plante

(10) Patent No.: US 8,727,496 B2
(45) Date of Patent: May 20, 2014

(54) PRINTING

(75) Inventor: Jean-Frederic Plante, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 699 days.

(21) Appl. No.: 12/744,672

(22) PCT Filed: Nov. 29, 2007

(86) PCT No.: PCT/US2007/024530

§ 371 (c)(1), (2), (4) Date: May 25, 2010

(87) PCT Pub. No.: WO2009/070136

PCT Pub. Date: Jun. 4, 2009

(65) Prior Publication Data

US 2010/0245443 A1 Sep. 30, 2010

(51) Int. Cl.
*B41J 2/14* (2006.01)

(52) U.S. Cl.
USPC ..... 347/49; 347/42

(58) Field of Classification Search
USPC ..... 347/19, 42, 49
See application file for complete search history.

(56) References Cited

U.S. PATENT DOCUMENTS

| | | | | |
|---|---|---|---|---|
| 5,057,854 | A | 10/1991 | Pond et al. | |
| 5,198,054 | A | 3/1993 | Drake et al. | |
| 5,576,744 | A * | 11/1996 | Niikura et al. | 347/14 |
| 5,889,534 | A * | 3/1999 | Johnson et al. | 347/19 |
| 6,227,659 | B1 * | 5/2001 | Lopez et al. | 347/68 |
| 6,981,755 | B2 * | 1/2006 | Lim | 347/20 |
| 7,093,926 | B2 | 8/2006 | Gil | |
| 2006/0055714 | A1 * | 3/2006 | Kuwahara et al. | 347/5 |

FOREIGN PATENT DOCUMENTS

EP 0914950 A2 5/1999

* cited by examiner

*Primary Examiner* — Alessandro Amari
*Assistant Examiner* — Justin Seo

(57) ABSTRACT

A method of printing includes firing a first group of one or more printheads at a moving medium at a first firing angle to the medium and firing a second group of one or more printheads at the moving medium at a second, different, firing angle to the medium.

20 Claims, 18 Drawing Sheets

Figure 7
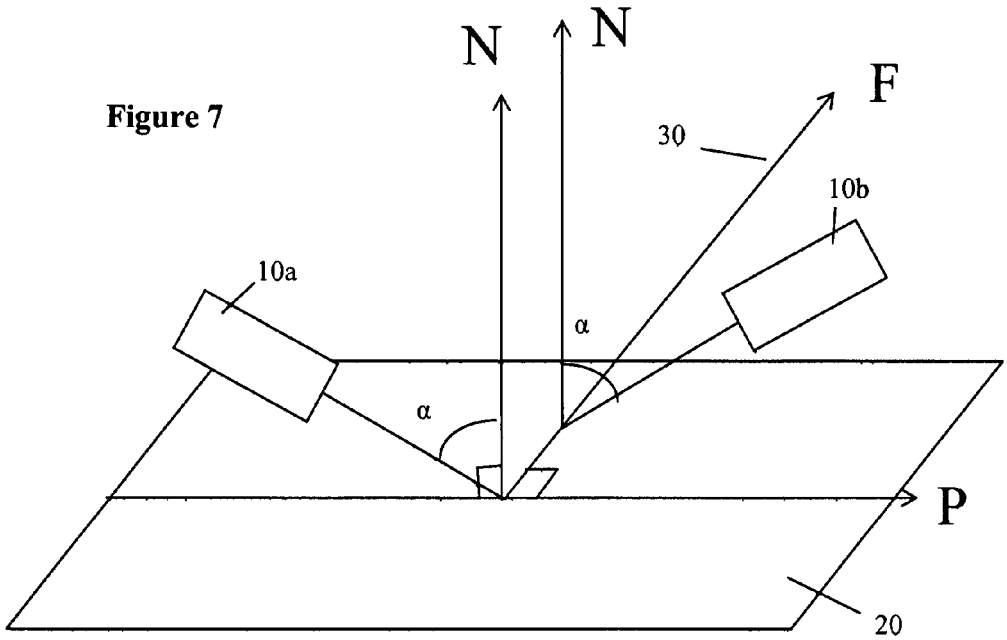
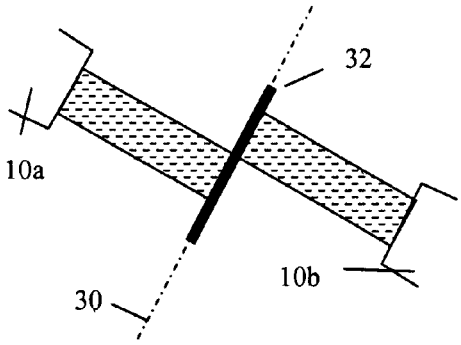
Figure 8
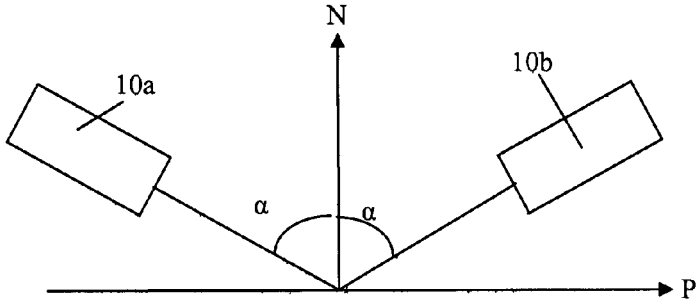
Figure 9

Figure 26
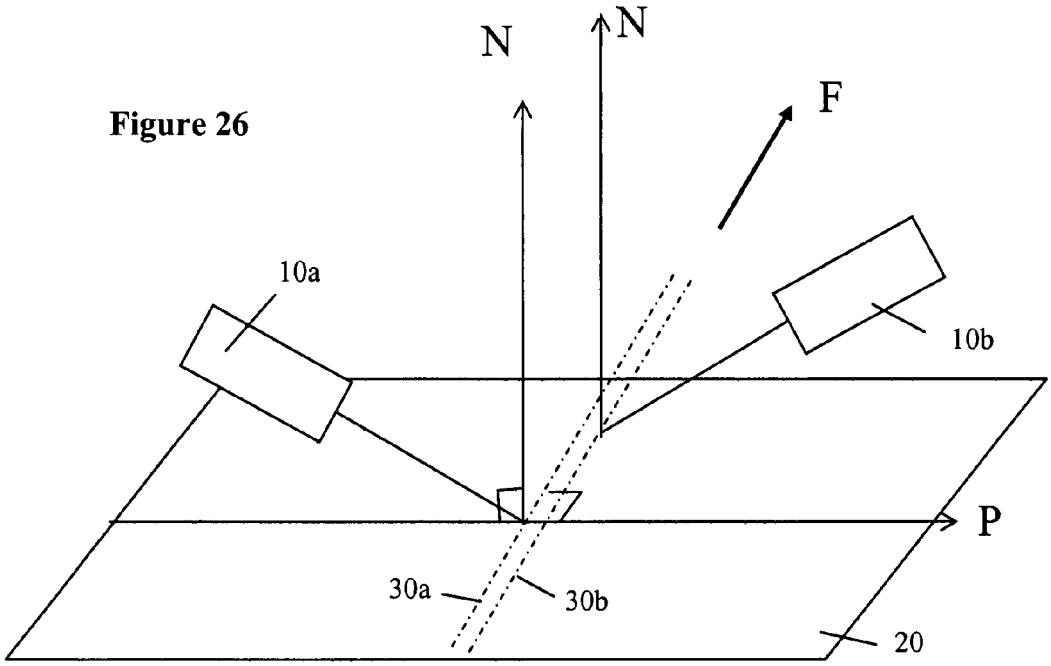
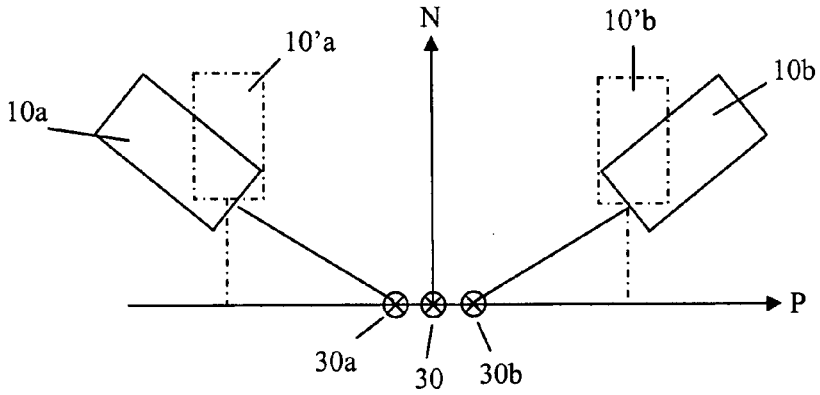
Figure 27

PRINTING

A commonly used form of printer uses a moving printhead which scans from side to side across a print medium so as to build up a printed image on the medium. In this type of printer the print medium is generally stationary as the printhead is reciprocated back and forth. In this way swaths of an image are printed on the medium, with the print medium being stepped after each swath. In contrast, in so-called "page wide array" or "full width" printers, fast printing can be achieved by using a fixed printhead array which spans the full width of the area of the medium to be printed. In such printers the print medium generally moves continuously with respect to the stationary printheads during the printing operation.

Full width array printheads are difficult and costly to manufacture in one unitary ("monolithic") printhead. The failure of any one of a large number of nozzles in a printhead can cause the loss of the entire full width printhead array. Because of this most full width array printheads are assembled from smaller subunits which can be individually tested prior to assembly into the full width printhead array.

Embodiments of the invention are set out according to the appended claims.

An embodiment of the invention provides a method of printing on a product comprising firing a plurality of fixed printheads at a moving product to produce ink marks on the product wherein said firing comprises firing ink at a first angle to the medium and, substantially simultaneously, firing ink at a second, different, angle to the medium.

In an embodiment of the invention the ink marks lay substantially along a common axis on the product.

In an embodiment of the invention the first angle is an obtuse angle and the second angle is an acute angle with respect to the forward direction of the medium.

An embodiment of the invention provides a printer comprising a plurality of printheads and a medium carrier arranged to move a print medium in front of the firing faces of the printheads, wherein the plurality of printheads comprises a first group of printheads arranged with firing faces at a first angle to the surface of the medium carrier and a second group of printheads arranged with firing faces at a second, different, angle to the surface of the medium carrier.

In embodiments of the invention the first group of printheads may comprise a single printhead as may the second group of printheads. In other embodiments of the invention each of the first and second groups of printheads may comprise a plurality of printheads. In this case each printhead in a group of printheads may have the same firing angle or the firing angles may be different to each other. In some cases one of the groups of printheads comprises a single printhead whilst the other group of printheads comprises a plurality of printheads.

The number of printheads in the first group of printheads may or may not match the number of printheads in the second group of printheads. That is the total number of printheads may be an odd or an even number.

In some embodiments the printheads are fired substantially simultaneously.

An embodiment of the invention provides a printhead arrangement comprising a plurality of printheads the printhead arrangement having a V-shaped configuration.

An embodiment of the invention provides a printer comprising said printhead arrangement.

Embodiments of the invention will now be described by way of example with reference to the accompanying drawings.

Figure 5:
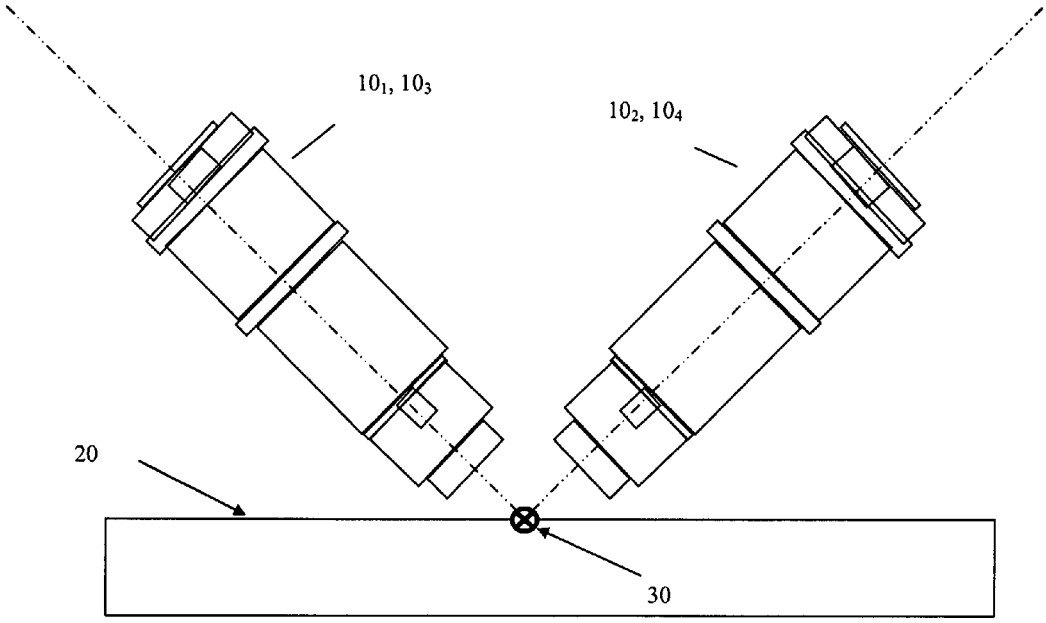
FIG. 5 is a schematic illustration of a side view of an array of printheads in relation to a print medium according to an embodiment of the invention.
Figure 5A:
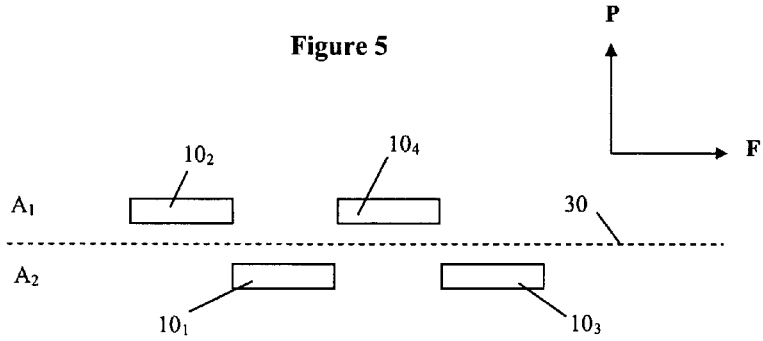
Figure 6:
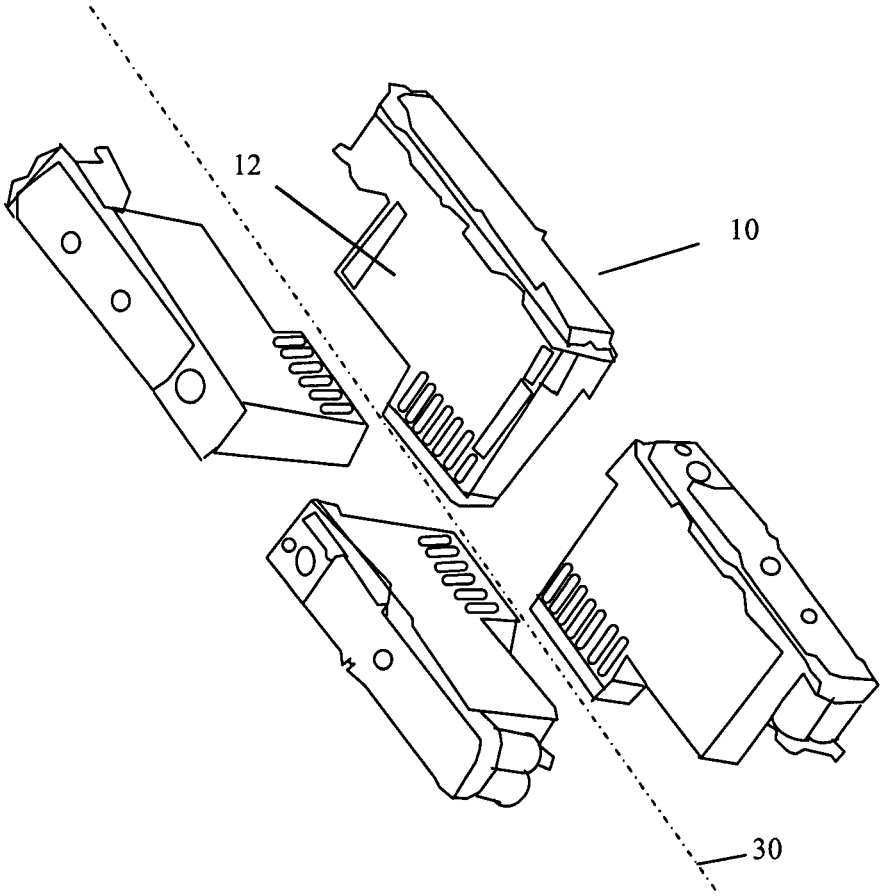
Figure 10:
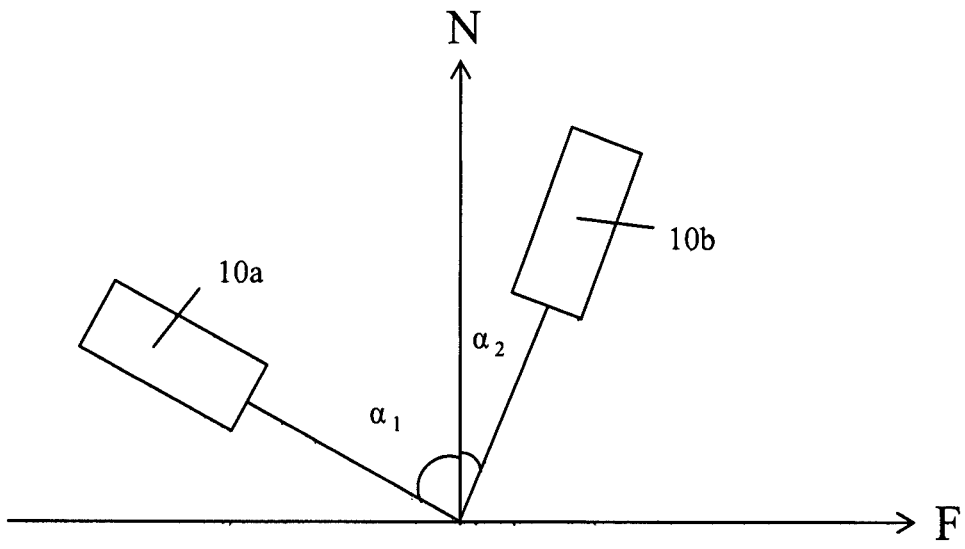
Figure 11:
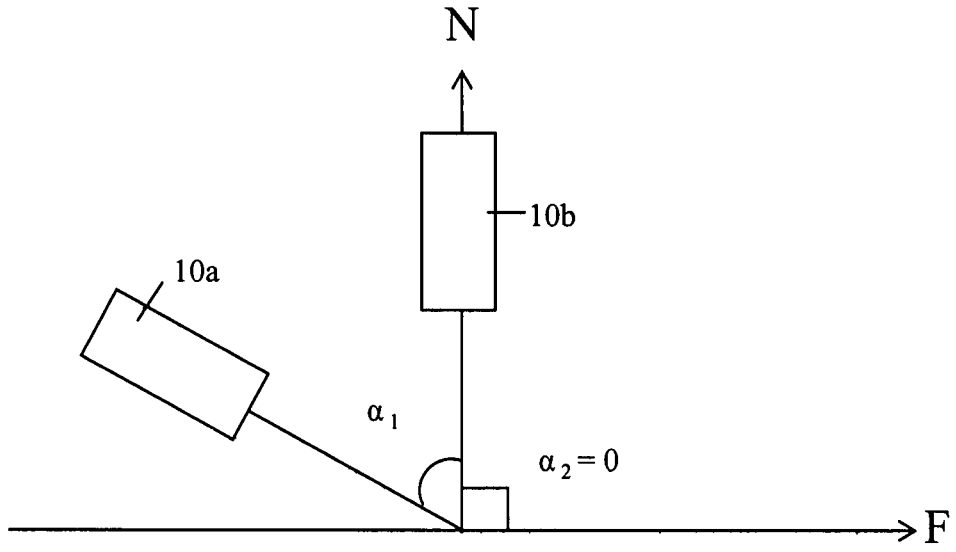
Figure 12:
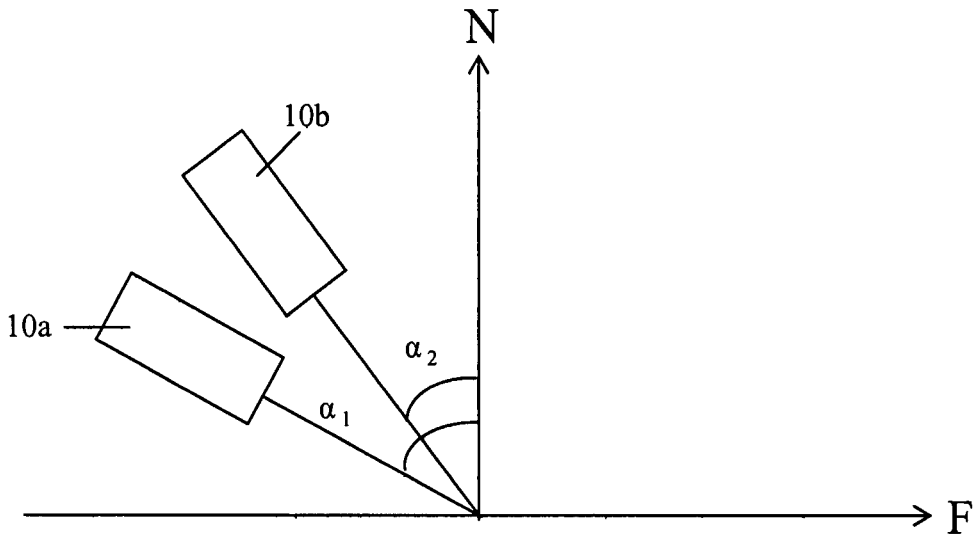
Figure 13:
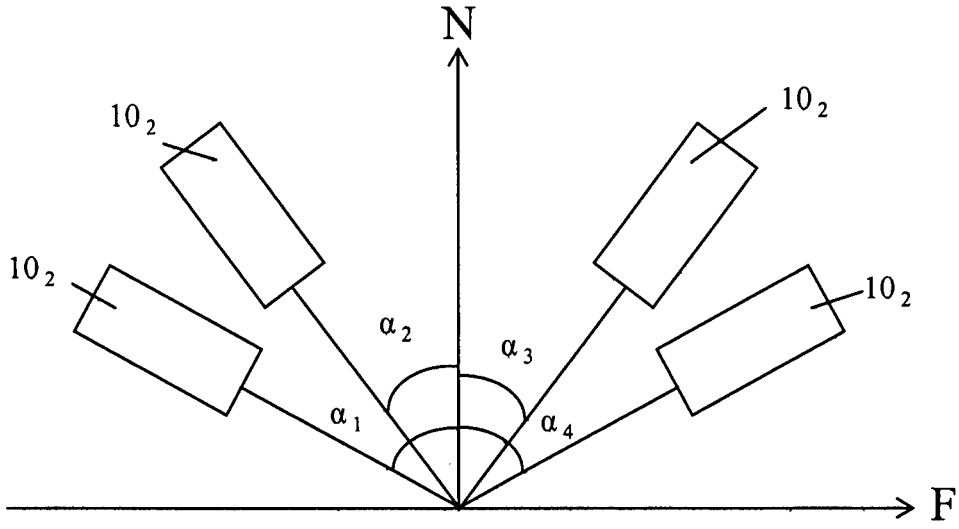
Figure 14:
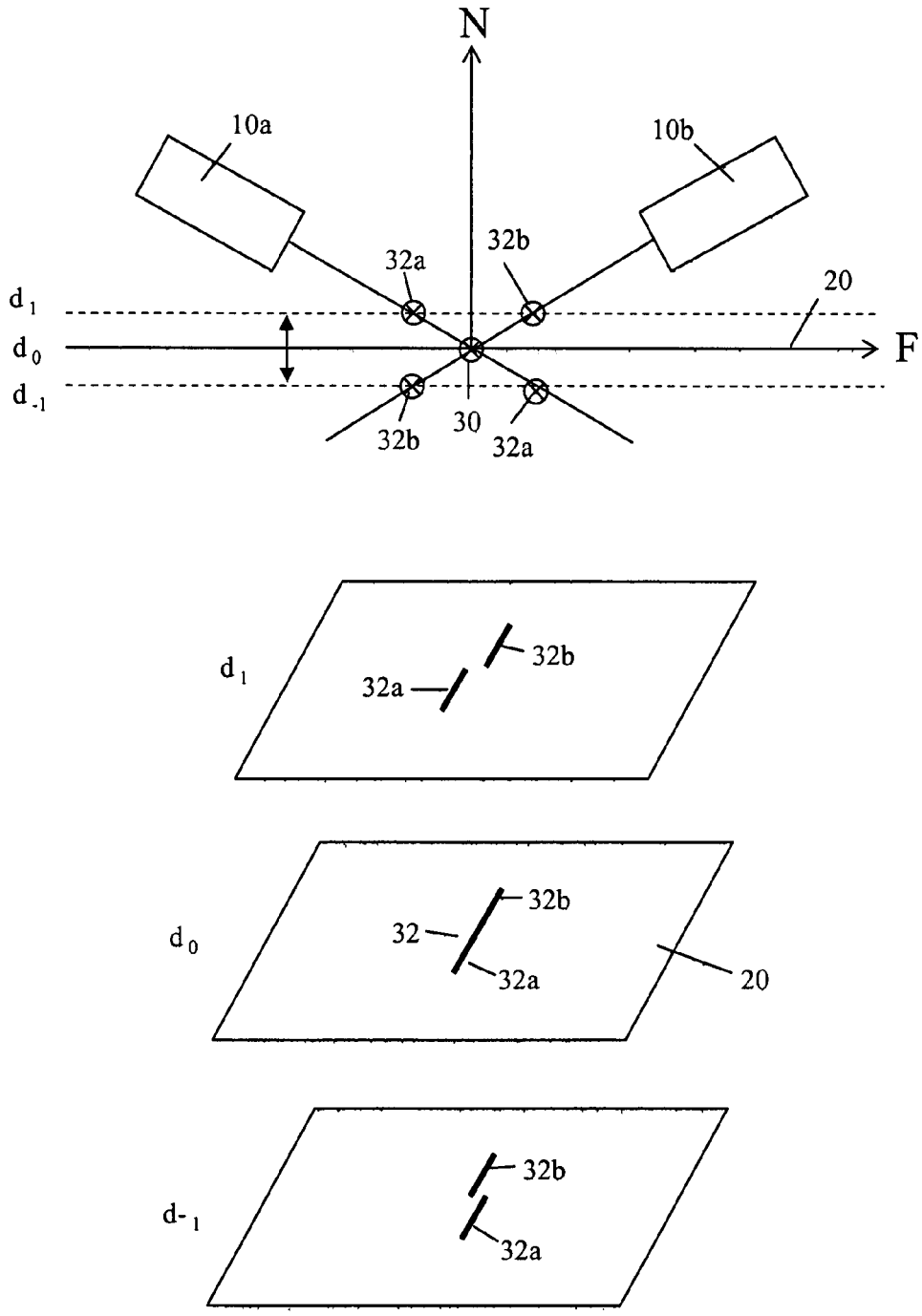
Figure 15:
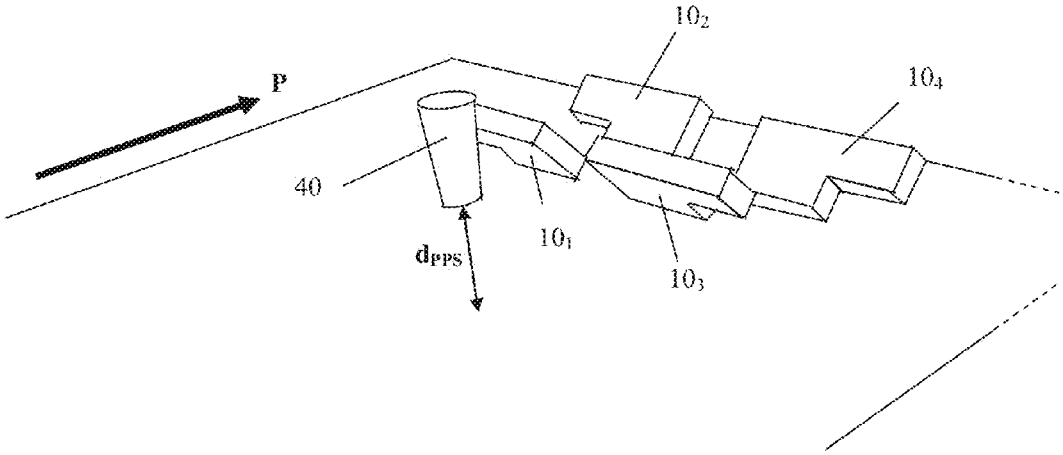
Figure 16:
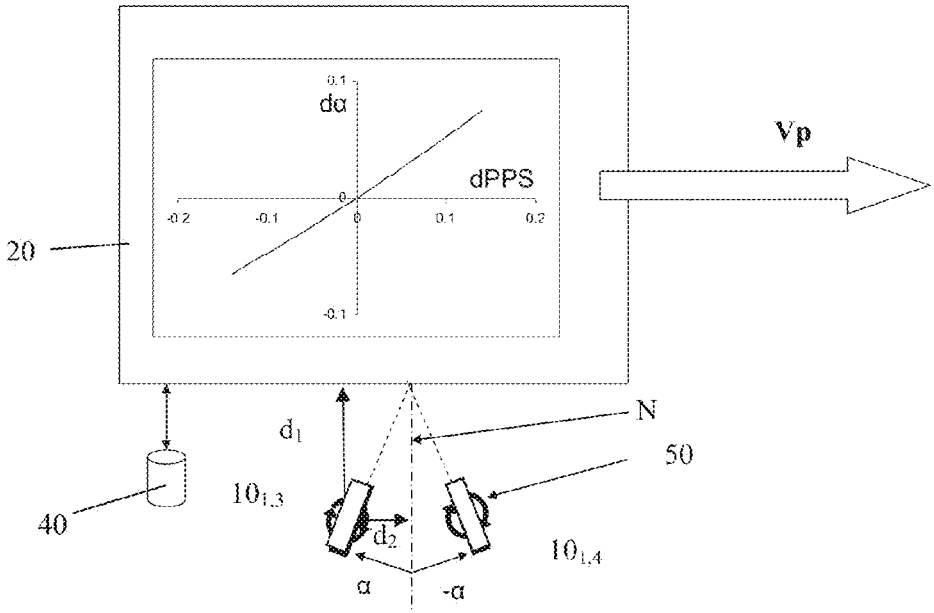
Figure 17:
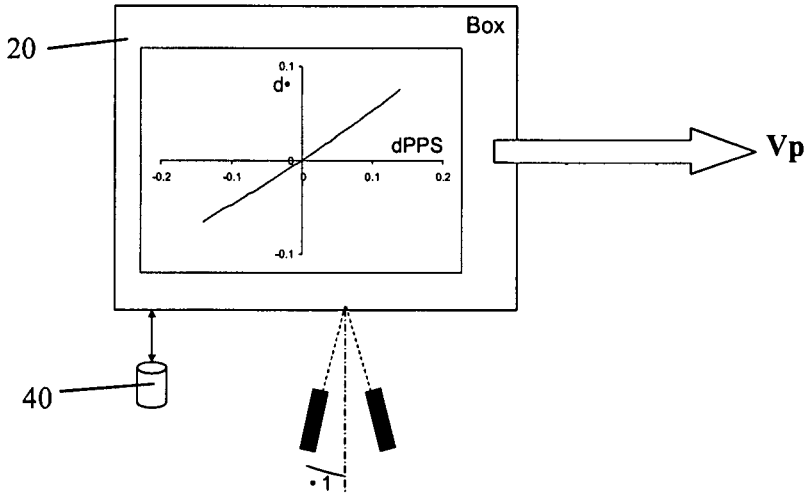
Figure 18:
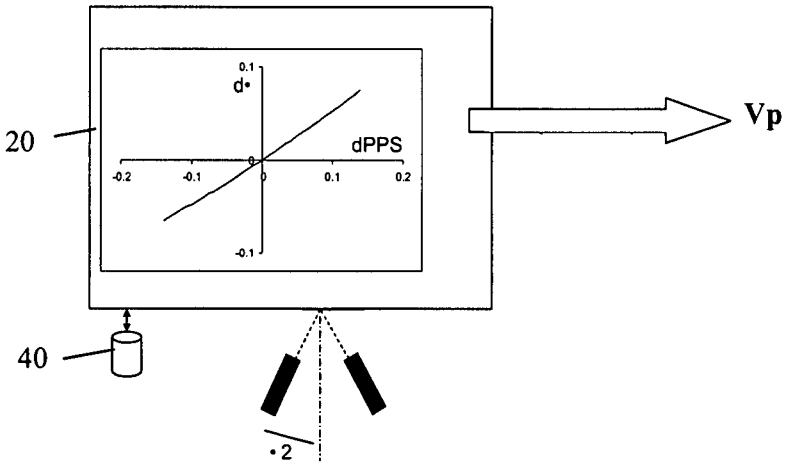
Figure 19:
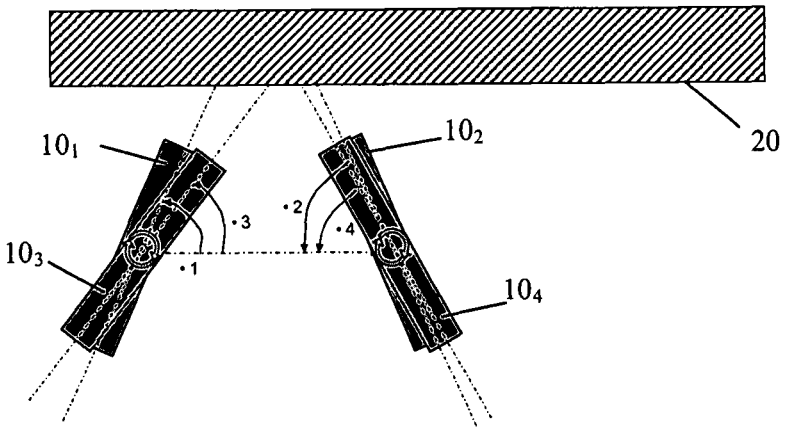
Figure 20:
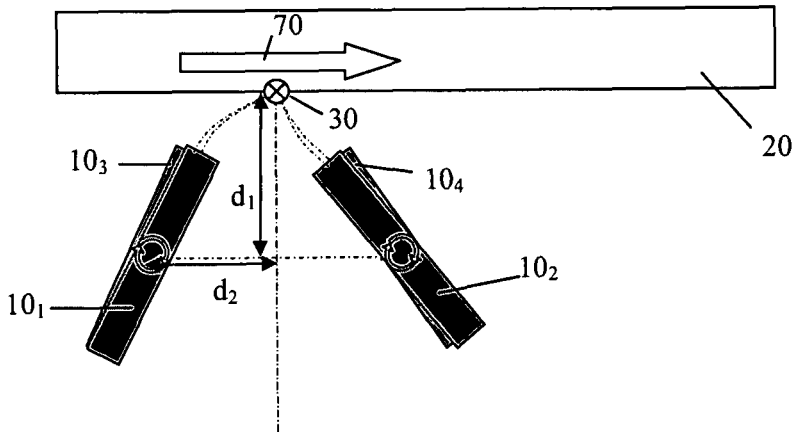
Figure 21:
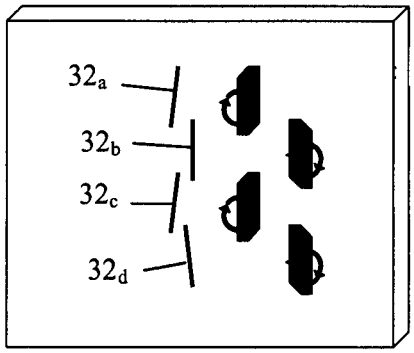
Figure 22:
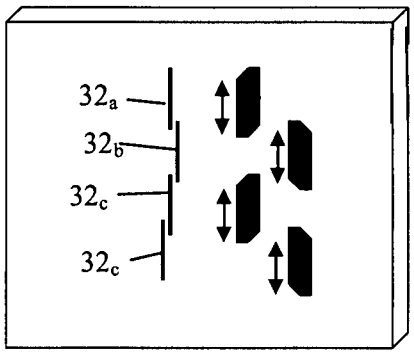
Figure 23:
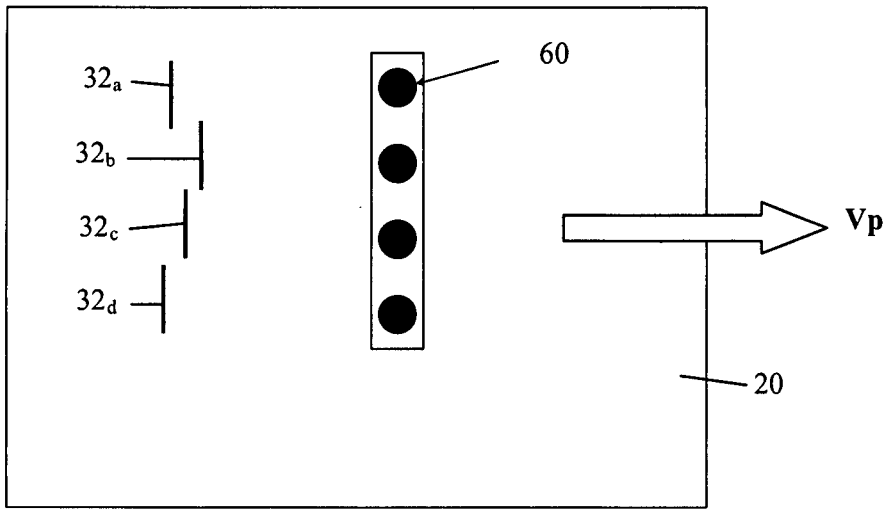
Figure 24:
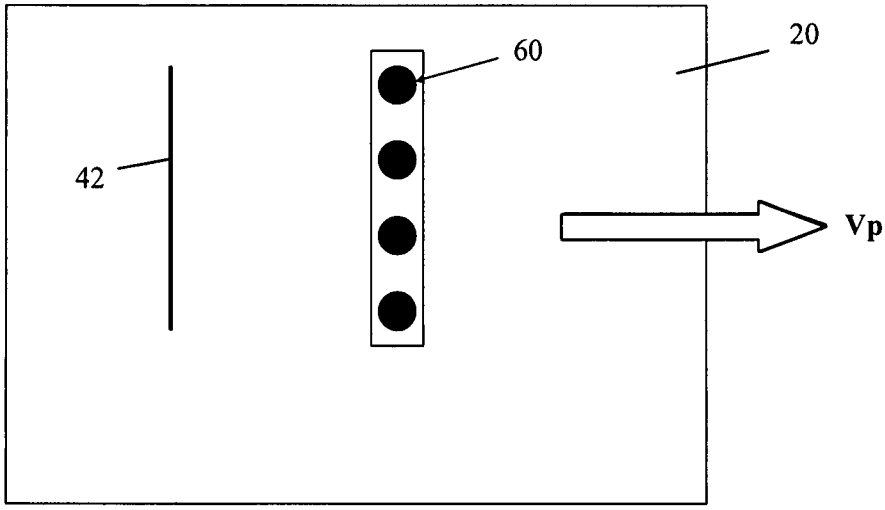
Figure 25:
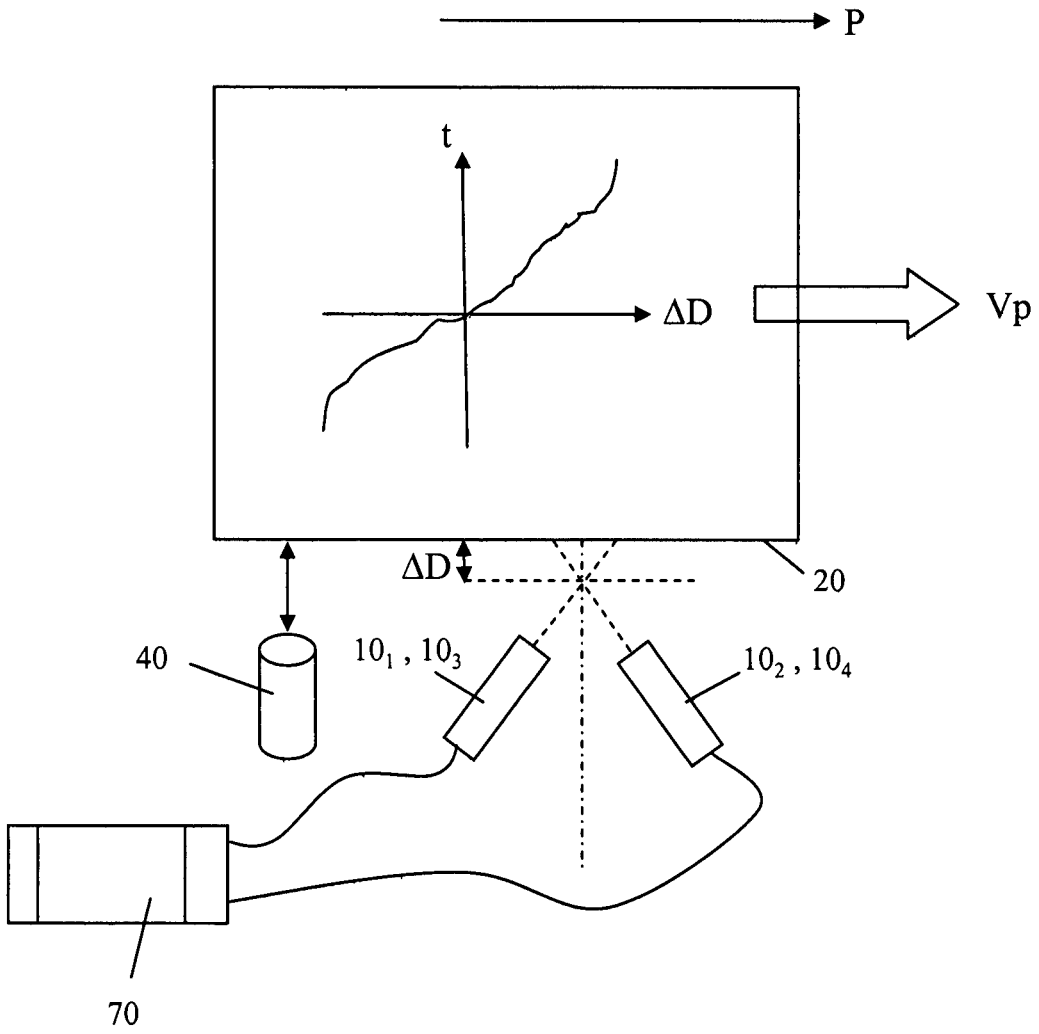

FIG. 5*a* is a schematic illustration of a plan view of an array of printheads according to an embodiment of the invention;

FIG. 6 is a schematic illustration of a first view an array of "Godzilla" printheads according to an embodiment of the invention;

FIG. 7 is a schematic illustration of an oblique view of an array of printheads printing onto a printing surface according to an embodiment of the invention;

FIG. 8 is a schematic illustration of the ink ejected from two printheads forming a printed line on a print surface according to an embodiment of the invention;

FIG. 9 is a side view of two printheads printing onto a printing surface, according to an embodiment of the invention, in which the firing angle of one of the printheads is equal and opposite to the firing angle of the other printhead;

FIG. 10 is a side view of two printheads printing onto a printing surface, according to an embodiment of the invention, in which the firing angle of one of the printheads is greater than the firing angle of the other printhead;

FIG. 11 is a side view of two printheads printing onto a printing surface, according to an embodiment of the invention, in which the firing angle of one of the printheads is perpendicular to the printing surface and the firing angle of the other printhead is not perpendicular to the printing surface;

FIG. 12 is a side view of two printheads printing onto a printing surface, according to an embodiment of the invention, in which the firing angle of one of the printheads has the same sign but a different magnitude than the firing angle of the other printhead;

FIG. 13 is a side view of four printheads printing onto a printing surface, according to an embodiment of the invention, in which the firing angles of the printheads are different;

FIG. 14 is a side view of two printheads printing onto a printing surface, according to an embodiment of the invention, schematically illustrating the effect on printing of the distance of the printheads from the print surface;

FIG. 15 is an oblique view of a printhead arrangement and a distance sensor according to an embodiment of the invention;

FIG. 16 is a side view of an angle adjustment system according to an embodiment of the invention;

FIG. 17 is a side view of a printhead arrangement adjusted, according to an embodiment of the invention, to compensate for an increased printing distance;

FIG. 18 is a side view of a printhead arrangement adjusted, according to an embodiment of the invention, to compensate for a reduced printing distance;

FIG. 19 is a side view of a printhead arrangement according to an embodiment of the invention, in which each printhead has individual angle adjustment;

FIG. 20 is a side view of a printhead arrangement, according to an embodiment of the invention, showing the effect of air flow on the drop trajectory of ink ejected from the printheads;

FIG. 21 schematically illustrates a printhead arrangement according to an embodiment of the invention, in which each printhead has individual angle adjustment;

FIG. 22 schematically illustrates a printhead arrangement according to an embodiment of the invention, in which each printhead has a translation adjustment in the format direction;

FIG. 23 is a plan view of a sensor for detecting print alignment according to an embodiment of the invention;

FIG. 24 is a plan view of a sensor for detecting print alignment and a reference line for calibrating the sensor according to an embodiment of the invention;

FIG. 25 schematically illustrates a compensation system for controlling the firing times of the printheads in a printhead arrangement according to an embodiment of the invention;

FIG. 26 is a schematic illustration of an oblique view of an array of two printheads printing onto a printing surface according to an embodiment of the invention;

FIG. 27 is a side view of the two printheads illustrated in FIG. 26.

In page wide array printers the print medium is normally kept in constant motion during the printing operation. Such printers are suited to large scale printing as may be found in, for example, industrial or commercial applications. In one example the printing may be onto manufactured products were the products are handled in a production line type of process. Page wide array printers may commonly be used to print onto boxes, CD/DVD cases, and for package coding (eg printing bar codes). Page wide array printers are also useful for mail addressing and transaction printing in which the product/print medium is moving rapidly so as to provide a high processing throughput.

Figure 1:
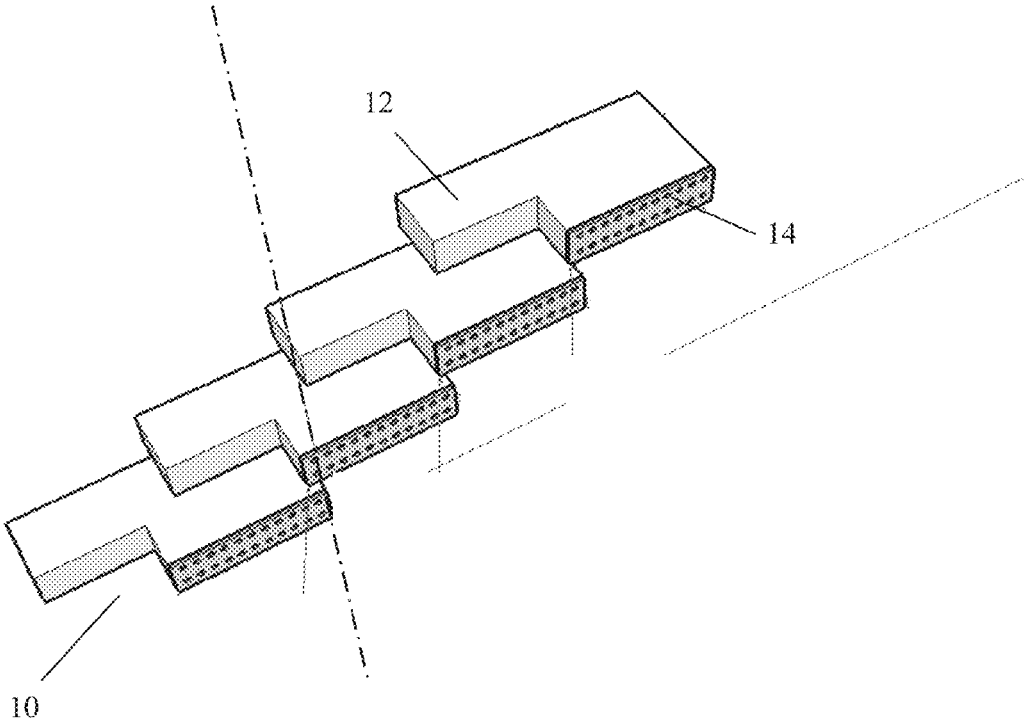
FIG. 1 is a schematic illustration of an array of printheads presented as background to an embodiment of the invention.
Figure 2:
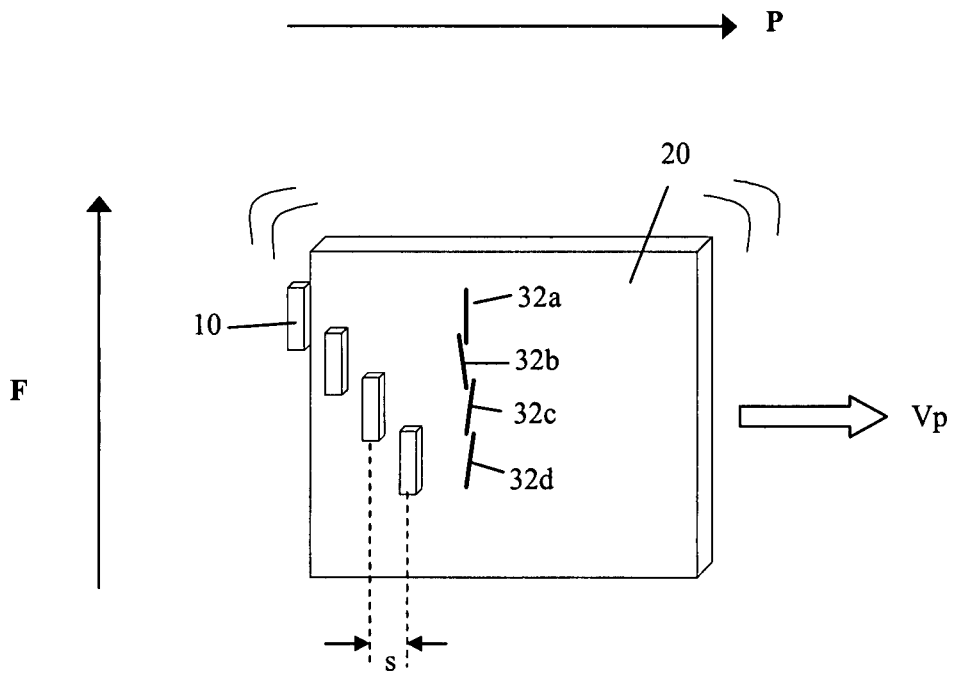
FIG. 2 is a schematic illustration of an array of printheads printing on a product presented as background to an embodiment of the invention.

FIG. 1 and FIG. 2 illustrate an example of a page wide array system for printing onto a print medium 20. The system includes an array of printheads 10 that span the width of the region of the print medium 20 which is to be printed on. The region to be printed on may be the full width of the print medium 20 or may only cover part of the width of the print medium 20. During printing, the printheads 10 are stationary and the print medium 20 is moved in a process direction, P, as the printheads 10 eject ink onto the print medium 20. In the example illustrated in FIG. 2 the print medium 20 is a product which for illustration purposes takes the form of a box 20 and the system may, for example, be operated to print a bar code onto the box 20.

The print medium is moved relative to the printheads by a carrier. The carrier may be, for example, a carriage or a drum. The carrier could also be a conveyor belt (as may be used to transport boxes in front of the printheads) or any other mechanical means for moving the print medium 20.

The printheads 10 shown in FIGS. 1 and 2 are staggered in the process direction, P, so as to accommodate the electrical connections 12 of the printheads 10. If the electrical connections 12 were to lie within the footprint of the active face 14 (the "nozzle plate" in inkjet printers) of the printhead 10 it may be possible to abut the printheads 10 so that they lay end-to-end across the width of the printhead array. For an abutted array the distance between the end nozzle of one printhead 10 and the first nozzle of an adjacent, abutted, printhead 10 should equal to the distance between the nozzles within each printhead 10. This is difficult to achieve within the mechanical tolerances of the printheads 10. By staggering the printheads 10 in the process direction, as illustrated in FIGS. 1 and 2, it is possible to position the printheads 10 so that the end nozzle of one printhead 10 is correctly aligned with the end nozzle of an adjacent printhead 10.

Referring to FIG. 2, if the print medium 20 (in this illustration a box) is moving with a velocity of $V_P$ and the distance between neighbouring printheads 10 in the process direction, P, is s, then in order for the printheads 10 to print a single continuous line on the box 20 it will be necessary for the firing of each printhead 10 to be delayed by a time $\Delta t = s/V_P$ with respect to the printhead in front of it in the process direction P. The production of a printed line in this way relies on the box 20 moving at constant speed and in a constant direction. Generally, in most real world applications, the box 20 will be subjected to undesired movements, for example the box 20 may wobble. As illustrated in FIG. 2, the undesired movement of the box 20 will mean that the box 20 will be in a slightly different position when one particular printhead 10 fires to the position of the box 20 when a neighbouring printhead 10 is fired at a later time $t = t + \Delta t$. Therefore the undesired movement of the box 20 can cause a variation of angular position of each line 32*a*-32*d* produced by each respective printhead 10 with respect to the box 20 and a broken line is produced as is illustrated in FIG. 2.

Figure 3:
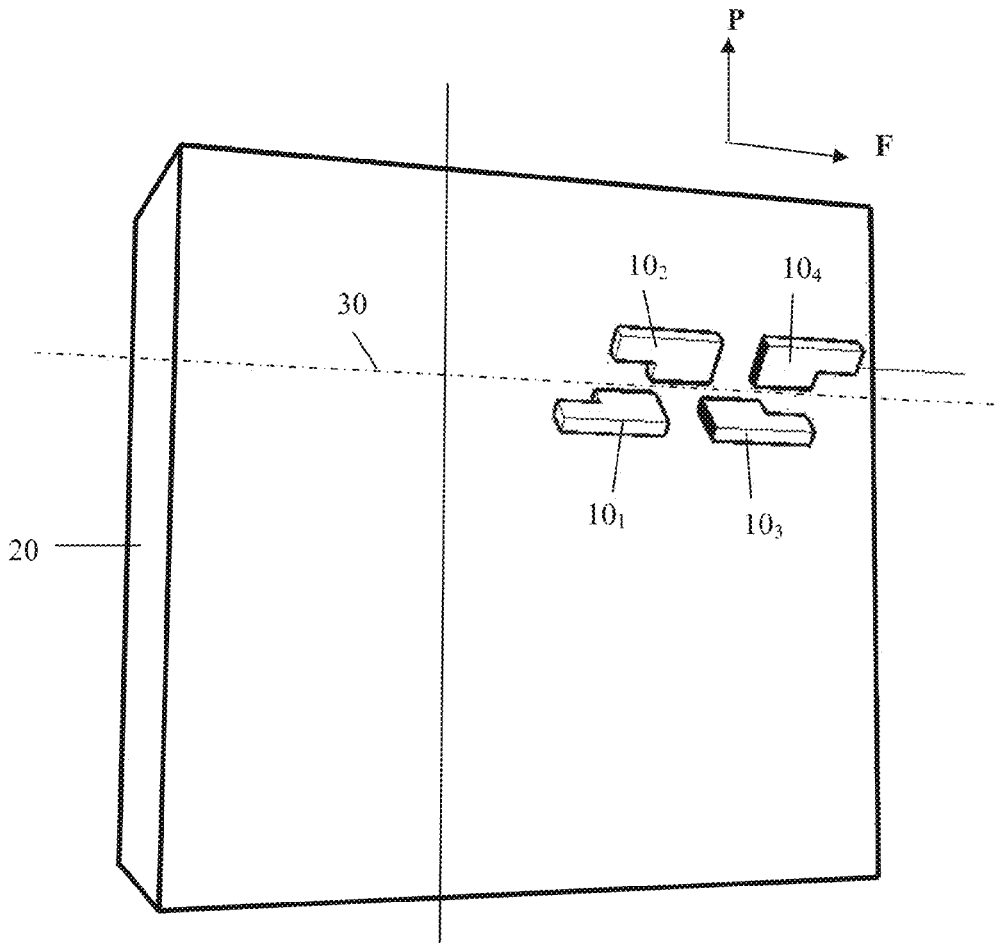
FIG. 3 is a schematic illustration of a first view of an array of printheads printing on a product according to an embodiment of the invention.
Figure 4:
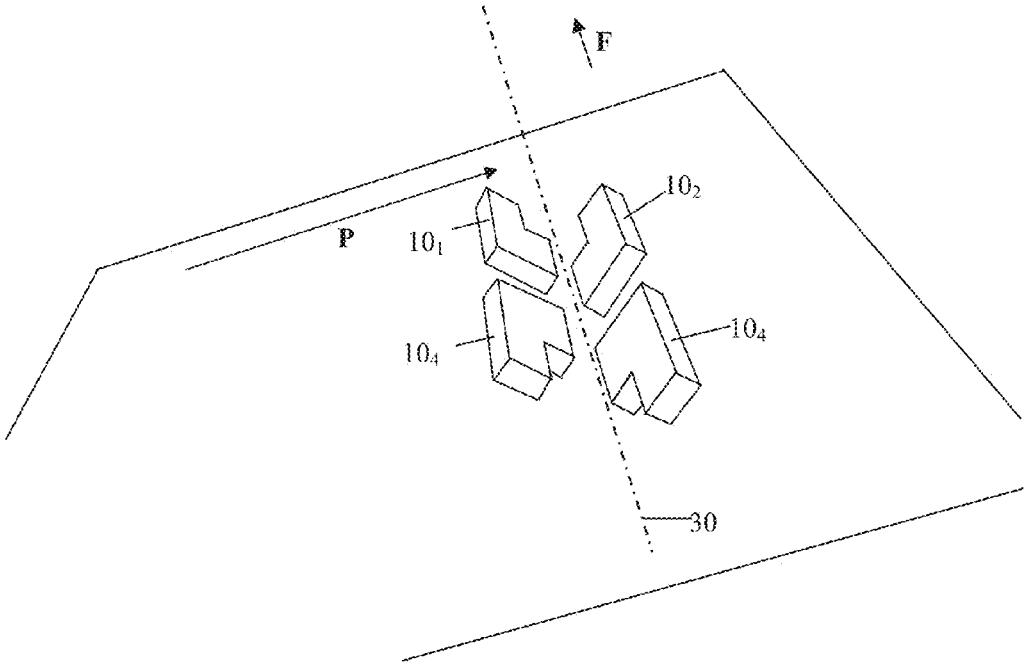
FIG. 4 is a schematic illustration of a second view of an array of printheads printing on a product according to an embodiment of the invention.

FIGS. 3, 4, 5 and 5*a* shown different views of a printhead arrangement of one embodiment of the present invention in which a plurality of printheads 10 have a V-shaped configuration. The printheads 10 are arranged so that they can eject ink at the print medium 20 so as to mark the print medium 20 along a common axis 30 or "print axis". The common axis 30 is normally chosen to be perpendicular to the process direction as is illustrated in FIGS. 3 and 4. In FIG. 5 the common axis 30 is illustrated extending normally into the plane of the paper. The direction perpendicular to the process direction, P, is often referred to as the "format" direction and is labelled as 'F' in FIGS. 3 and 4.

Referring still to FIGS. 3 to 5*a*, a first group of two printheads $\mathbf{10}_1$ and $\mathbf{10}_3$ point in the forward direction (i.e. having a direction with a component in the process direction P) and a second group of two printheads $\mathbf{10}_2$ and $\mathbf{10}_4$ point in the backward direction (i.e. having a direction with a component in the direction opposite to the process direction P (i.e. −P)). The direction that a printhead 10 points can be defined by the angle that the normal from the firing face (nozzle plate) of the printhead 10 makes with the normal to the print medium 20 and can be termed the "firing angle" of the printhead 10. Of course, the firing angle could also be defined by the angle that the normal from the firing face of the printhead 10 makes with the surface of the print medium 20 (or it can be defined in relation to the direction that ink droplets are actually fired from the printhead).

For the printhead arrangement shown in FIGS. 3 to 5*a* the group of printheads that lie on a particular side of the print axis 30 (i.e. $\mathbf{10}_1$ and $\mathbf{10}_3$ or $\mathbf{10}_2$ and $\mathbf{10}_4$) are spaced apart in the direction of the print axis 30 (i.e. in the format direction F for the example illustrated).

The printheads are usually comprised of two arrays of printheads ("pens") A1 and A2 which are spaced apart in the process direction P with the printheads (pens) of each array spaced apart in the direction of the print axis 30 (i.e. in the format direction F). The arrays are staggered in the print axis direction so that the printheads of one array are at a different place along the print axis 30 than those of the other array—that is there are two interlaced sets of printheads. In this way more space each side of a printhead is achieved. FIG. 5*a* is a plan view of an example printhead arrangement showing two printhead arrays with each array having two printheads.

FIG. 6 illustrates a set of four printheads 10 and illustrates how angling the printheads 10 and staggering the printheads 10 in the format direction, F, allows the printheads 10 to be arranged to print onto a common axis 30 whilst providing the space required to accommodate the electrical interconnections 12 of the printheads 10. The printheads 10 illustrated in FIG. 6 are Hewlett-Packard "Godzilla" printheads 10.

The printhead array is not limited to the arrangement of four printheads 10 illustrated in FIGS. 3 to 6. For example the printhead array may comprise two printheads 10 angled toward each other or the array may include three printheads 10 or a number of printheads 10 greater than four. The number of printheads 10 used in the printhead array generally depends on the size of each of the printheads 10 used and the width of the print medium 20 that the printhead array is required to cover (i.e. print on).

FIG. 7 illustrates a printhead arrangement having two printheads 10*a* and 10*b* in a V-shaped arrangement. One printhead 10*a* points in the forward process direction P at an angle $\alpha$ to the normal N to the print medium 20 whilst the other printhead 10*b* points in the direction opposite the process direction P also at an angle $\alpha$ to the normal to the print medium 20. The printheads 20 are spaced apart in the format direction F. FIG. 8 is a schematic representation of the ink ejected from the printheads 10 which falls on the print medium 20 along a common axis 30 on the medium 20. The two printheads 10 can be aligned so that the ejected ink forms a continuous line 32 along the common axis 30. FIG. 9 illustrates the same arrangement from a side view.

As illustrated in FIG. 10, the printheads 10*a*, 10*b* in a two-printhead arrangement may point so that they have different angles to the normal to the print medium 20 ($\alpha_1$ and $\alpha_2$). In FIG. 11, one of the two printheads 10*b* may make an angle that is perpendicular to the print medium 20 ($\alpha_2$=0). FIG. 12 illustrates a configuration in which each of the two printheads 10*a*, 10*b* has an angle to the normal to the print medium 20 which is on the same side of the normal N to the print medium 20.

FIG. 13 illustrates a printhead arrangement having four printheads $10_1$-$10_4$. In the example illustrated two printheads $10_1$ and $10_3$ making acute angles with the print medium 20 ($\alpha_1$ and $\alpha_2$ to the normal N), i.e. the printheads are forward pointing, and the other two printheads $10_2$ and $10_4$ make obtuse angles ($\alpha_3$ and $\alpha_4$ to the normal) to the print medium 20 i.e. are backward pointing. The printheads $10_{1\text{-}4}$ may be configured in any one of many other variations for example the two forward pointing printheads $10_1$ and $10_3$ may make the same angle to the print medium 20 ($\alpha_1=\alpha_2$) as may the two backward pointing printheads ($\alpha_3=\alpha_4$).

The printhead configurations are arranged so as to print along the same axis (a unique line) for a given distance of the printheads 10 to the printing surface. If the printing distance (often referred to in the printing arts as the "Pen to Paper Spacing" or "PPS") changes then, for a particular printhead arrangement, the printheads 10 would no longer print a single continuous line and would instead print segments of a line. FIG. 14 illustrates two printheads 10*a* and 10*b* which each print a respective line 32*a* and 32*b*. The printheads 10*a*, 10*b* are angled toward a printing medium 20 so that they can print a single line 32 along a common axis 30 when the printheads 10 are at a specific, nominal, distance $d_{PPS}=d_0$ from the print medium 20. If there is a deviation from this specific distance $d_0$ so that the print medium 20 is closer to the printheads 10 (at a distance $d_{PPS}=d_1$) then, if the printheads fire simultaneously, ink from one printhead 10*b* will mark the print medium 20 at a different position in the process direction P than ink from the other printhead 10*a*. That is printhead 10*b* will produce a line 32*b* on the print medium 20 that is forward of the line 32*a* produced by printhead 10*a*. Similarly, if there is a deviation from distance $d_0$ so that the print medium 20 is further to the printheads 10 (at a distance $d_{PPS}=d_{-1}$) then, if the printheads 10 fire simultaneously, printhead 10*a* will produce a line 32*a* on the print medium 20 that is forward of the line 32*b* produced by printhead 10*b*.

FIGS. 15 and 16 illustrates a system that comprises a distance sensor 20 that measures the distance $d_{PPS}$ of the printheads 10 to the printing surface of the print medium 20. By way of illustrative example four printheads $10_1$, $10_2$, $10_3$, and $10_4$ are shown with two printheads $10_1$ and $10_3$ located on the side of the common ("print") axis 30 which first passes in front of the printheads and the other two printheads $10_2$ and $10_4$ located on the other side of the common axis 30. Referring to FIG. 16 the symbol "$\alpha$" labels the angle between the normal to the printing surface and the normal to firing face of printhead $10_1$ and printhead $10_3$ (eg normal to the nozzle plates when the printheads are inkjet printheads). Similarly, the symbol "$-\alpha$" labels the angle between the normal to the printing surface and the normal to firing face of printhead $10_2$ and printhead $10_4$. The system comprises an angle adjustment mechanism 50 that allows, for example, adjustment of angles $\alpha$ and/or angle $-\alpha$. The angle adjustment mechanism 50 may, for example, comprise a stepper motor or a solenoid system for pivoting one or more of the printheads 10.

For the example illustrated in FIG. 16 the angle adjustment mechanism 50 is shown to act on both printheads that lie on a particular side of the common print axis 40 (i.e. $10_1$ and $10_3$ or $10_2$ and $10_3$). In other embodiments the adjustment mechanism allows for the angle of each of the printheads 10 to be adjusted independently from each other. For example independent angle adjustment could be used when the printheads on a particular side of the common print axis 40 (eg $10_1$ and $10_3$ or $10_2$ and $10_3$) point at different angles to the normal to the printing surface. Also it is possible that the firing angle of only some (i.e. a subset) of the printheads 10 are adjusted in response to measurements by the distance sensor 40. For example, adjustment of the printheads 10 so that they fire onto a common axis 30 for a given printing distance ($d_{PPS}$) can be achieved by adjusting the firing angle of only the printheads on a particular side of the common print axis 40 ($10_1$ and $10_3$ or $10_2$ and $10_3$).

Referring still to FIG. 16 the angle $\alpha$ of printheads $10_1$ and $10_3$ is set at a nominal printing angle $\alpha=\alpha_0$ when the printing surface of the print medium 20 is at a nominal distance, $d_{PPS}=d_0$, so that the printheads print onto a common axis 30 on the print surface. When $d_{PPS}$ is greater than the nominal distance $d_0$, as shown in FIG. 17, then the angle can be reduced, i.e. $\alpha=\alpha_1<\alpha_0$, so that ink from the printheads will land along the same axis 30 on the print medium 20. When $d_{PPS}$ is less than the nominal distance $d_0$, as shown in FIG. 18, then the angle can be increased, i.e. $\alpha=\alpha_2>\alpha_0$, so that ink from the printheads 10 will land along the same axis 30 on the print medium 20.

In one embodiment the angle of the printheads 10 are not adjusted in response to a measurement of $d_{PPS}$ and instead the angle is adjusted according to the printed output produced by the printhead arrangement. For example any misalignment of the printed output from each of the printheads 10 could be observed or measured and the angle of at least some of the printheads 10 could be altered so as to minimise or substantially minimise the misalignment. If the printheads 10*a*, 10*b* are operated to produce respective lines 32*a*, 32*b* then misalignment of the printheads would be observed as fragmentation of a single line 30 as illustrated in FIG. 14. In one scenario the misalignment is observed by a user/operator of the printing system who then makes an adjustment to the firing angle of at least some of the printheads 10 until the user/operator observes the misalignment being minimised (e.g. all the printheads print substantially along a common axis 30) or reduced to an acceptable level. In another scenario the misalignment is measured by an instrument, eg an optical instrument, and the firing angle is altered in response to this measurement either by a user/operator or automatically by the angle adjustment mechanism according to a signal originating from the instrument.

Referring again to FIG. 16, the ideal angle $\alpha$ that the printheads point can be characterised by the equation $\alpha=\arctan(d2/d1)$ where d1 is the normal distance between the rotation centre of the printheads 10 and the printing surface and d2 is half the distance between the two rotation centres. Under real world conditions, however, the drop trajectory of the ink ejected by the printheads 10 may be affected by factors such as the flow of air caused by the moving print medium 20. As illustrated in FIG. 20 it may be necessary that the angle $\alpha$ of printheads $\mathbf{10}_1$ and $\mathbf{10}_3$ be different to the angle $\alpha$ of printheads $\mathbf{10}_2$ and $\mathbf{10}_4$ in order that the ink ejected from the printhead lands along a common axis 30 on the print medium 20. FIG. 19 illustrates a system in which the angle of each printhead 10 can be individually set or adjusted to compensate for effects on the trajectory of the ink drops. For example the angle may be adjusted in-situ so as to achieve acceptable alignment of the printed output from the printheads 10.

Various geometric adjustments to the printhead configuration can be made so that the printheads 10 print along the same axis (eg a unique line) with improved precision for a given distance $d_{PPS}$ to the printing surface. Various degrees of freedom may be adjusted to improve alignment as illustrated in FIGS. 19 to 22. FIGS. 19 to 21 show individual angle adjustments for the printheads 10 whereas FIG. 22 illustrates how the printheads 20 may be translated in the format direction, F, to adjust for any overlap between the line segments 32*a*, 32*b*, 32*c* and 32*d* that make up a single line 32. The line segments 32*a*, 32*b*, 32*c* and 32*d* are shown staggered in the process direction, P, in FIGS. 21 and 22 for illustration purposes only (so that the line segments can be distinguished from each other) and the printhead array will generally be configured so that the line segments 32*a*, 32*b*, 32*c* and 32*d* lie along the same common axis 30 in the format direction F.

Due to perturbations caused by real world conditions (eg airflow from the moving print medium 20) in one embodiment identification of the correct firing angle $\alpha$ of the printheads may be performed in-situ in a calibration process. Referring to FIG. 23 a sensor, eg in the form of a line of sensors 60, may be employed to detect printed marks on the print medium 20 (e.g. lines 32*a*, 32*b*, 32*c* and 32*d* in the example illustrated in FIG. 23) and automatically adjust the alignment of the printheads 10. FIG. 24 illustrates the use of a reference line 42 for calibration of the line sensor array 60.

A further technique that can be used for correcting variations of the distance, $d_{PPS}$, of the printing surface from the printheads from the nominal distance $d_0$ is to adjust the firing times of the printheads 10. FIG. 25 illustrates a triggering unit/delay unit 70 that can be used to control the firing times of the printheads 10 so that the ink from the printheads will land on the printing surface of the print medium 20 substantially along a common axis 30 on the print surface. The triggering unit/delay unit 70 may be controlled automatically or manually according to the measurement of $d_{PPS}$ from a distance sensor 40 or according to the alignment of the printed output as observed by eye or detected by a sensor (such as the line sensor 60 illustrated in FIGS. 23 and 24).

If the printing distance error, $\Delta D$, (eg as measured by the sensor 40) is zero then all of the printheads 10 are triggered simultaneously in order that printing is achieved along a common axis 30 on the print medium 20. If $\Delta D>0$, as is illustrated in FIG. 25, the printing surface is further than the nominal distance $d_0$ and in order to print along the same axis 30 on the print medium 20 printheads $\mathbf{10}_1$ and $\mathbf{10}_3$, which are "downstream" of the common axis 30 (i.e. +P from the common axis 30), are fired t milliseconds in advance of printheads $\mathbf{10}_2$ and $\mathbf{10}_4$, which are "upstream" of the common axis 30 (i.e. −P from the common axis 30). If $\Delta D<0$ the printing surface is closer than the nominal distance $d_0$ and in order to print along the same axis 30 on the print medium 20 printheads $\mathbf{10}_1$ and $\mathbf{10}_3$ are fired t milliseconds after printheads $\mathbf{10}_2$ and $\mathbf{10}_4$.

The time difference, t, at which printheads $\mathbf{10}_1$ and $\mathbf{10}_3$ are fired can be characterised in terms of the angle of the normal from the firing face/nozzle plate with respect to the normal to the printing surface, i.e. the firing angle $\alpha$, and the printing distance error, $\Delta D$, using the equation $t=2\Delta D\tan(\alpha)/V_P$ where $V_P$ is the velocity of the print medium in the process direction. If $\Delta D>0$ then t will take a positive value implying that an advance needs to be applied to the printheads $\mathbf{10}_1$ and $\mathbf{10}_3$. If $\Delta D<0$ then t will take a negative value implying that a delay needs to be applied to the printheads $\mathbf{10}_1$ and $\mathbf{10}_3$. As has been discussed in relation to FIG. 19, in real situations perturbation due to, for example air flow, may affect the trajectory of ink ejected from the printheads 10. In this case the firing times may need to be determined experimentally or in-situ on the printing apparatus.

It is preferable, as has been discussed previously, that the printheads 10 fire substantially simultaneously or least within a short time period of each other so that unwanted movement of the print medium 20 (i.e. movement other than in the process direction P) does not cause alignment errors in the printed output. In one embodiment of the invention the firing angle of at least some of the printheads 20 is adjusted to improve alignment of the printed output and the firing times of the printheads 10 are then adjusted to further improve alignment. In one sense the angle adjustment could be considered coarse adjustment/tuning and the firing time adjustment can be considered fine adjustment/tuning. Generally the firing times of the printheads 10 can be accurately controlled by electronic circuitry (for example to the order of microseconds or nanoseconds or better) and the firing times of the various printheads 10 may be close enough together such that undesired movement of the print medium 20 will not cause artefacts in the printed output. If, for example, the firing times were used to compensate for a distance of, say, 1 mm (that could be taken to be the equivalent of the thickness of a printed line, eg a line as may be used as part of a bar code), then at a process speed of, say, 3 m/s the firing times would be adjusted by just 330 microseconds.

FIGS. 26 and 27 illustrate a printhead arrangement in which two printheads 10*a* and 10*b* are arranged so that they have different firing angles to the medium 20. The printhead arrangement shown in FIGS. 26 and 27 is similar to the printhead arrangements shown in FIGS. 7 to 12 apart from the fact that the firing angles of the printheads 10*a*, 10*b* are such that if the printheads 10*a*, 10*b* are fired simultaneously then the ink from the printhead will not land along a common axis. Instead the printheads would print along two different, substantially parallel axis 30*a* and 30*b*. This may be because the distance of the printheads 10*a*, 10*b* from the print medium (i.e. the PPS) is short and/or the printheads 10*a*, 10*b* are large so that the freedom to chose the firing angle is restricted. For example the firing angle may be steeper (i.e. smaller when the firing angle is measured with respect to a normal from the printing surface) than that required for the ink to simultaneously land along a common axis 30.

The firing times of the printheads 10*a*, 10*b* illustrated in FIGS. 26 and 27 can be adjusted, for example in much the same way has been described in relation to FIG. 25, to enable ink fired from the printheads 10*a*, 10*b* to produce marks along a common axis 30. As has been discussed hereinbefore, non-simultaneous firing of the printheads 10*a*, 10*b* can lead to artefacts due to undesirable/unpredicted movements of print medium between the firing times. By having printheads 10*a*, 10*b* that are angled toward each other the delay between the firing times of the printheads 10*a*, 10*b* can be reduced greatly and any artefacts due to undesired movements of the print medium 20 are either negligible or greatly improved compared to the artefacts that would be present with printheads 10'*a* and 10'*b* arranged to fire perpendicular to the surface of the print medium, 20 (as illustrated as dashed lines in FIG. 27).

Although embodiments of the invention have been described with reference to the printing of a bar code onto a box the invention is widely applicable to many applications and can be used to print any image onto any print medium or substrate, for example addresses printed directly onto envelopes, or images onto a substrate, or some other use.

An embodiment of the invention provides an inkjet printer having a printing zone where, in use, a substrate to be printed upon will reside, and a first printhead arranged to eject ink at a first angle inclined to a plane normal to the plane of the surface of the substrate to be printed on, and a second printhead arranged to eject ink at a second, different, angle to the normal plane.

In some embodiments each of the printheads has an elongate extent extending generally parallel with the elongate axis of the other printhead, such that, in use, they print lines having substantially the same direction/orientation on the substrate and the first and second angles of the positions of the printheads being such that, in use, the lines printed on the substrate are substantially contiguous.

In some embodiments the first and second angles are on opposite sides of a plane normal to the surface of the substrate.

In some embodiments the inkjet printer has: a first array of printheads with each printhead having an elongate extent and the printheads being spaced apart in the elongate direction; and a second array of printheads with each printhead having an elongate extent and the printheads being spaced apart in the elongate direction and interleaved with the printheads of the first array.

It should be appreciated that embodiments of the invention described and/or claimed in a particular category should also be taken to be disclosed in other categories. For example it should be appreciated that any particular printhead arrangement can be utilised in a printer/printing system and that the printhead arrangement of a particular printer/printing system may be made or sold separately from the printer/printing system. Similarly embodiments of the invention disclosed as methods can be realised as printers configured to perform such methods and vice versa.

I claim:

1. A method of printing comprising firing a first group of one or more printheads at a moving medium with faces of the first group of printheads at a first firing angle to the moving medium and firing a second group of one or more printheads at the moving medium with faces of the second group of printheads at a second, different, firing angle to the moving medium, wherein the first group of printheads fire in a direction that has a component in a direction of movement of the moving medium and the second group of printheads fire in a direction that has a component in a direction opposite to the direction of movement of the moving medium.

2. The method of claim 1, wherein ink from the first and second groups of printheads mark the moving medium substantially along a common axis on the moving medium.

3. The method of claim 1, wherein ink fired from the printheads hits the moving medium substantially simultaneously.

4. The method of claim 2, wherein the common axis is perpendicular to a direction of movement of the moving medium.

5. The method of claim 1, further comprising adjusting the angle of at least one of the printheads in response to a measurement of a distance between the printheads and the moving medium.

6. The method of claim 1, further comprising adjusting a time at which one or more of the printheads are fired in response to a measurement of a distance of the printheads to the moving medium.

7. The method of claim 1, further comprising detecting an alignment of printed marks produced by the printheads and adjusting, in response to said detecting, one of:

the firing angle of one or more of the printheads;

the firing time of one or more of the printheads; and the firing angle of one or more of the printheads and the firing time of one or more of the printheads.

8. A printer, comprising:

a plurality of printheads;

a carrier for moving a print medium with respect to the printheads, wherein one or more of the printheads are arranged to fire ink at a first angle having a component in a direction of movement of the print medium and one or more of the printheads are arranged to fire ink at a second angle having a component in a direction opposite the direction of movement of the print medium; and an angle adjustment mechanism operable to adjust the angle of at least one of the printheads.

9. The printer of claim 8, wherein the printheads are arranged such that, in use, ink from the printheads mark the print medium substantially along a common axis.

10. The printer of claim 8, further comprising a sensor to measure a distance from the printheads to the print medium wherein the angle adjustment mechanism is operable to adjust the angle of at least one of the printheads in response to the distance measured by the sensor.

11. The printer of claim 8, further comprising a controller operable to adjust a firing time of at least one of the printheads.

12. The printer of claim 11, further comprising a sensor to measure a distance from the printheads to the print medium wherein the controller is operable to adjust the firing time of at least one of the printheads in response to the distance measured by the sensor.

13. The printer of claim 8, further comprising an alignment sensor to measure an alignment of printed output from the plurality of printheads and one of:

an angle adjustment mechanism configured to adjust the firing angle of at least one of the printheads in response to a measurement made by the alignment sensor;

a controller operable to adjust a firing time of at least one of the printheads in response to a measurement made by the alignment sensor; and an angle adjustment mechanism configured to adjust the firing angle of at least one of the printheads in response to a measurement made by the alignment sensor and a controller operable to adjust a firing time of at least one of the printheads in response to a measurement made by the alignment sensor.

14. A printhead arrangement comprising a first group of one or more printheads and a second group of one or more printheads wherein the first group of printheads are arranged with faces thereof at a first angle to a print medium to eject ink in a first direction having a component in a direction of movement of the print medium and the second group of printheads are arranged with faces thereof at a second angle to the print medium to eject ink in a second, different, direction having a component in a direction opposite to the direction of movement of the print medium such that, in use, ink ejected from the printheads will fall on the print medium substantially along a common axis on the print medium.

15. The printhead arrangement of claim 14 wherein each of the first and second group of printheads comprise a plurality of printheads which are spaced apart in a format direction.

16. The printhead arrangement of claim 15 wherein the printheads of the first group of printheads are interleaved with the printheads of the second group of printheads.

17. The printhead arrangement of claim 14 wherein the first group of printheads and the second group of printheads are configured to form a V-shape.

18. A printer comprising the printhead arrangement of claim 14.

19. The printer of claim 8, wherein the one or more of the printheads are arranged to fire ink with firing faces at the first angle to the print medium and the one or more of the printheads are arranged to fire ink with firing faces at the second angle to the print medium.

20. The method of claim 1, wherein each of the first and second group of printheads comprise a plurality of printheads which are spaced apart in a direction perpendicular to the direction of movement of the moving medium.

* * * * *